US010533724B2

(12) United States Patent
Kim et al.

(10) Patent No.: US 10,533,724 B2
(45) Date of Patent: Jan. 14, 2020

(54) LAMP FOR VEHICLE

(71) Applicant: SL Corporation, Daegu (KR)

(72) Inventors: Jongwoon Kim, Gyeongsangbuk-Do (KR); Nakjung Choi, Gyeongsangbuk-do (KR); Hyeongdo Kim, Gyeongsangbuk-do (KR); Kihae Shin, Gyeongsangbuk-do (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 16/037,289

(22) Filed: Jul. 17, 2018

(65) Prior Publication Data

US 2019/0024865 A1 Jan. 24, 2019

(30) Foreign Application Priority Data

Jul. 19, 2017 (KR) ..... 10-2017-0091366

(51) Int. Cl.
*F21S 41/20* (2018.01)
*F21S 41/40* (2018.01)

(52) U.S. Cl.
CPC ..... *F21S 41/285* (2018.01); *F21S 41/40* (2018.01)

(58) Field of Classification Search
CPC ..... F21S 41/285; F21S 41/40; F21S 41/265; F21S 41/26; F21S 41/20; F21S 43/20; F21S 43/26; F21V 5/004; F21V 5/008; F21V 5/043; F21V 5/045; F21V 5/002; G02B 5/021; G02B 3/08; G03B 21/602; G03B 21/625; G03B 21/60
See application file for complete search history.

(56) References Cited

U.S. PATENT DOCUMENTS

2006/0023306 A1* 2/2006 Miyata ..... G03B 21/625 359/460
2016/0265733 A1* 9/2016 Bauer ..... F21S 41/265
2019/0072252 A1* 3/2019 Moser ..... F21V 11/186

* cited by examiner

*Primary Examiner* — Y M. Lee
(74) *Attorney, Agent, or Firm* — Nelson Mullins Riley & Scarborough LLP; Kongsik Kim, Esq.

(57) ABSTRACT

Provided is a lamp for a vehicle capable of ensuring light efficiency to satisfy the performance requirements for light distribution. The lamp includes a light source portion, a first lens portion with a plurality of micro incident lenses onto which light generated by the light source portion is incident, a second lens portion with a plurality of micro exit lenses corresponding to the plurality of micro incident lenses, respectively, and a shielding portion with a plurality of shields that are disposed on rear focal points of the plurality of micro exit lenses to obstruct a portion of incident light. In particular, a focal distance of a micro exit lens among the plurality of micro exit lenses is shorter than a focal distance of a micro incident lens among the plurality of micro incident lenses, which corresponds to the micro exit lens.

11 Claims, 11 Drawing Sheets

| d2/d1 | CURVATURE OF MICRO EXIT LENS |
|---|---|
| 0.4~0.8 |   |
| LESS THAN 0.4 |   |

LAMP FOR VEHICLE

CROSS-REFERENCE TO RELATED APPLICATION

This application claims priority from Korean Patent Application No. 10-2017-0091366 filed on Jul. 19, 2017, the disclosure of which is incorporated herein by reference in its entirety.

BACKGROUND

1. Field of the Disclosure

The present disclosure relates to a lamp for a vehicle, and more particularly, to a lamp for a vehicle, which is capable of securing light efficiency for satisfying light distribution performance requirements by using a simple configuration.

2. Description of the Related Art

Generally, a vehicle includes a variety of types of lamps having an illumination function for recognizing an object disposed proximate to the vehicle during low light conditions (e.g., night) or a signaling function for informing other vehicles or road users proximate to the vehicle of a driving state of the vehicle.

For example, a headlamp, a fog lamp, and the like generally have the illumination function. A turn signaling lamp, a tail lamp, a brake lamp, a side marker lamp, and the like generally have the signaling function. Also, installation criteria and specifications for the lamps are regulated by law so that each lamp can adequately perform its function.

Recently, studies for reducing a size of a lamp for a vehicle by using a micro lens having a relatively short focal distance have been actively performed.

Among lamps for a vehicle, a headlamp, which forms a low beam pattern or a high beam pattern to ensure a front field of vision for a driver during nighttime driving, performs an important function for driving safety.

To secure a sufficient field of vision using a headlamp, it is necessary to satisfy performance requirements including a light amount, light efficiency, or the like. To satisfy the performance requirements, a method is solicited for reducing light loss when light generated by a light source passes through a lens and is emitted outward.

The above information disclosed in this section is merely for enhancement of understanding of the background of the disclosure and therefore it may contain information that does not form the prior art that is already known in this country to a person of ordinary skill in the art.

SUMMARY

Aspects of the present disclosure provide a lamp for a vehicle which is capable of satisfying the requirements for light distribution performance by adjusting a position of a focal point formed between a micro incident lens onto which light is incident from a light source, and a micro exit lens onto which the light which exits from the micro incident lens is incident.

It should be noted that objects of the present disclosure are not limited to the above-described objects, and other objects of the present disclosure will be apparent to those skilled in the art from the following descriptions.

According to the aspects of the present disclosure, a lamp for a vehicle may include a light source portion, a first lens portion with a plurality of micro incident lenses onto which light generated by the light source portion is incident, a second lens portion with a plurality of micro exit lenses that correspond to the plurality of micro incident lenses, respectively, and a shielding portion with a plurality of shields that are disposed on rear focal points of the plurality of micro exit lenses to obstruct a portion of light which is incident onto the plurality of micro exit lenses. Here, a focal distance of a micro exit lens among the plurality of micro exit lenses may be shorter than a focal distance of a micro incident lens among the plurality of micro incident lenses, which corresponds to the micro exit lens.

Additionally, each of the plurality of micro incident lenses may be a semicylindrical lens that extends in one direction, and the light which exits from the semicylindrical lens may be incident onto at least one of the plurality of micro exit lenses, which is arranged in the one direction in which the semicylindrical lens extends.

In particular, the focal distance of the micro exit lens may be 40% to 80% of the focal distance of the micro incident lens.

Further, in the first lens portion, the plurality of micro incident lenses may be formed on a surface of a first transmission portion that faces a direction toward the light source portion, and in the second lens portion, the plurality of micro exit lenses may be formed on a surface of a second light transmission portion from which light exits, wherein the first light transmission portion and the second light transmission portion may be disposed such that mutually facing surfaces abut each other.

The lamp may include the plurality of shields that are formed by a deposition on a surface of the second light transmission portion that faces the first light transmission portion. The first light transmission portion may have a thickness corresponding to the focal distance of the micro incident lens, and the second light transmission portion may have a thickness corresponding to the focal distance of the micro exit lens. The light source portion of the lamp may further include a light source and a light guide portion configured to guide the light generated by the light source to the first lens portion by adjusting an optical path of the light to be parallel to an optical axis of the light source. The light guide portion may be a Fresnel lens.

Additionally, a curvature of an exit surface of the micro exit lens may increase as the focal distance of the micro exit lens decreases, and the shielding portion of the lamp may be disposed closer to the second lens portion than the first lens portion.

Details of other examples are included in a detailed description and drawings.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
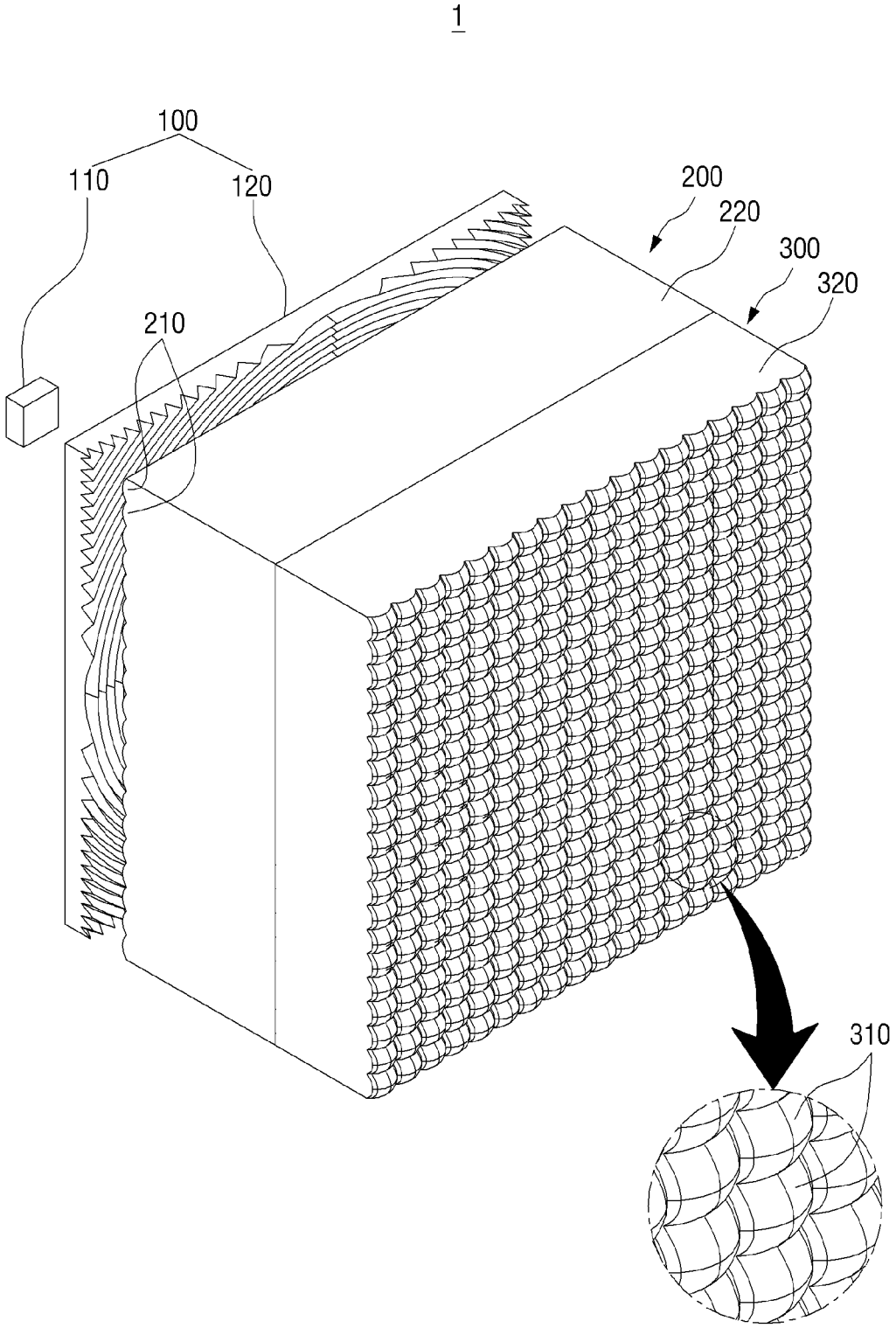
FIGS. 1 and 2 are perspective views of a lamp for a vehicle according to some exemplary embodiments of the present disclosure.

Advantages and features of the present disclosure and a method of achieving the same will become apparent with reference to the attached drawings and embodiments described below in detail. However, the present disclosure is not limited to the embodiments described below and may be embodied with a variety of different modifications. The embodiments are merely provided to allow one of ordinary skill in the art to completely understand the scope of the present disclosure and are defined by the scope of the claims. Throughout the specification, like reference numerals refer to like elements.

Accordingly, in some embodiments, well-known operations of a process, well-known structures, and well-known technologies will be not described in detail to avoid obscuring of understanding the present disclosure.

The terms used herein are for explaining embodiments but are not intended to limit the present disclosure. Throughout the specification, unless particularly defined otherwise, singular forms include plural forms. The terms "comprises" and/or "comprising" are used herein as meanings which do not exclude presence or addition of one or more other components, stages, and/or operations in addition to stated components, stages, and/or operations. Also, "and/or" includes each and one or more combinations of stated items.

Also, embodiments disclosed herein will be described with reference to perspective views, cross-sectional views, side views, and/or schematic diagrams which are exemplary views of the present disclosure. Accordingly, modifications may be made in the forms of exemplary views by manufacturing technology, allowable error, and/or the like. Accordingly, the embodiments of the present disclosure will not be limited to particular forms shown in the drawings and include changes made by a manufacturing process. Also, throughout the drawings of the present disclosure, components may be slightly exaggerated or reduced in consideration of convenience of description.

Hereafter, a lamp for a vehicle according to some exemplary embodiments of the present disclosure will be described with reference to the drawings.

Figure 2:
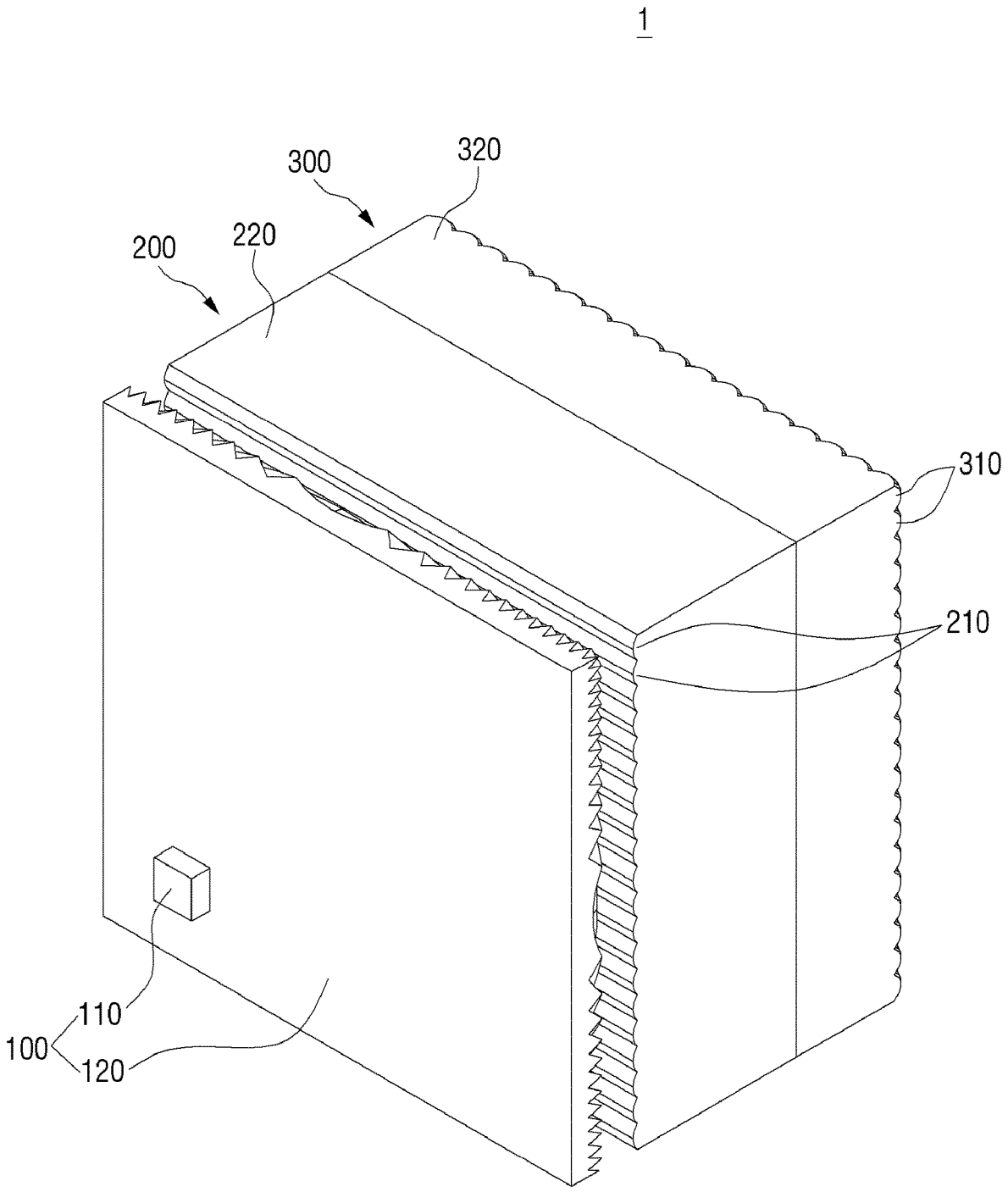
Figure 3:
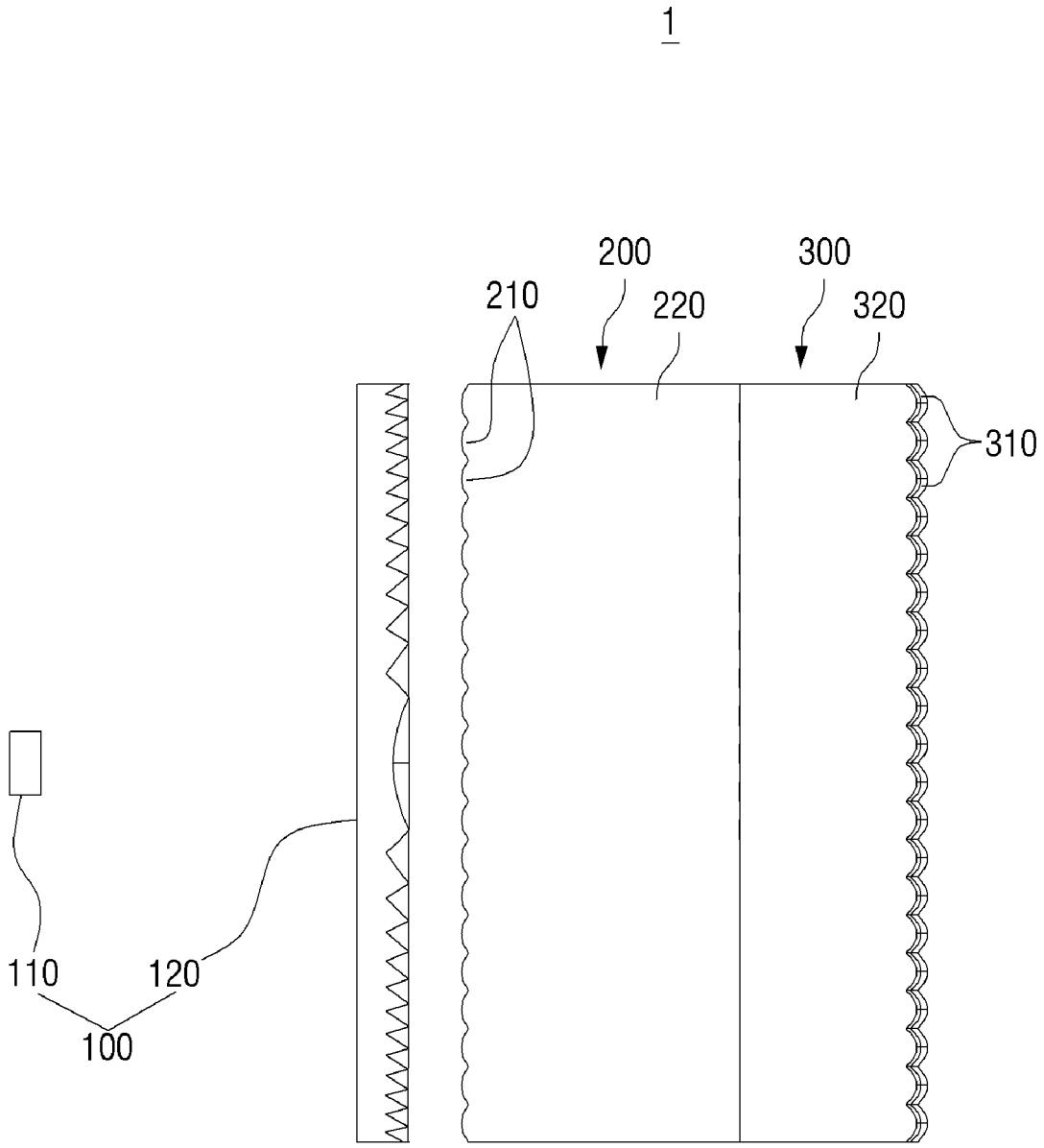
FIG. 3 is a side view of the lamp for the vehicle according to some exemplary embodiments of the present disclosure.
Figure 4:
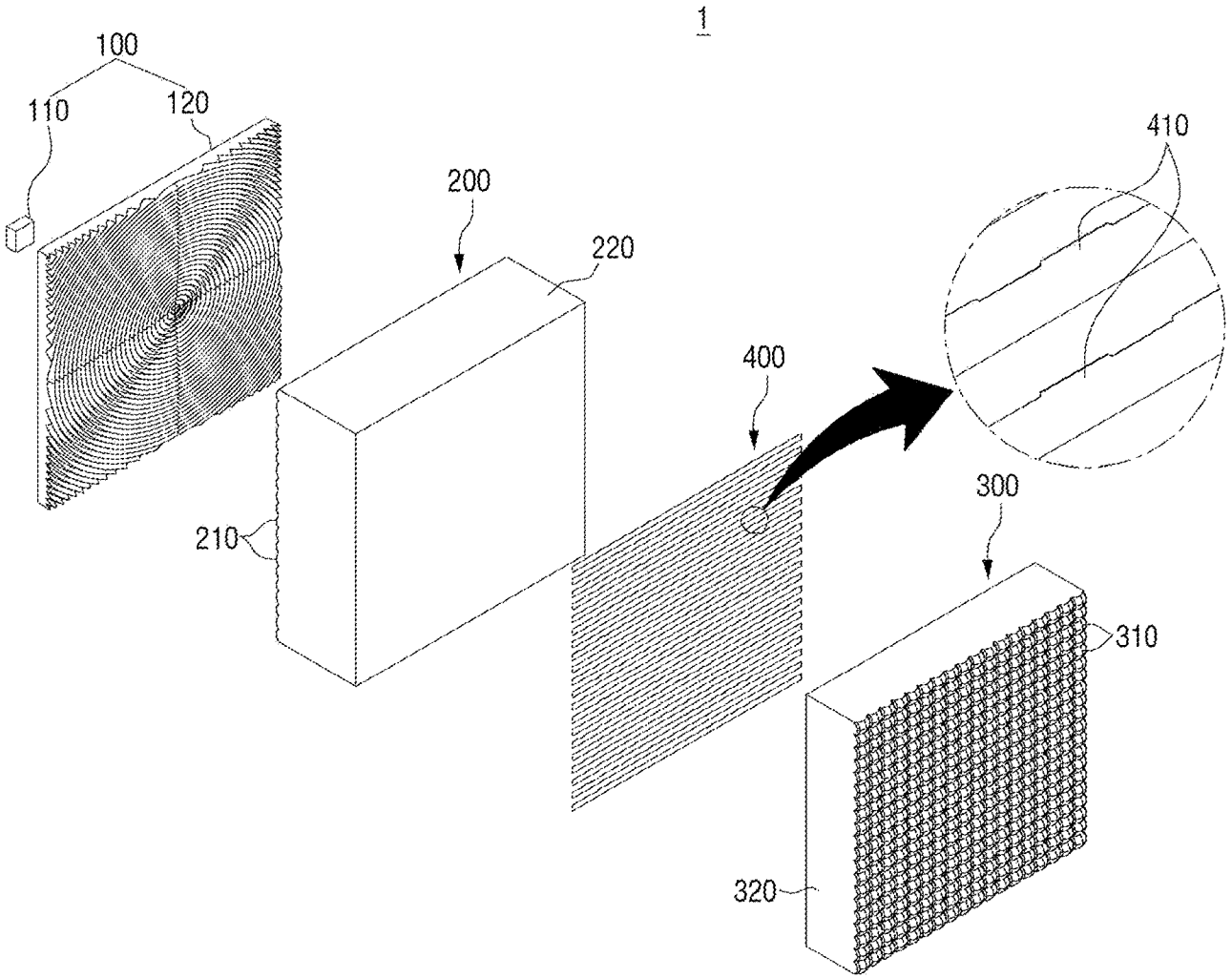
FIGS. 4 and 5 are exploded-perspective views of the lamp for the vehicle according to some exemplary embodiments of the present disclosure.
Figure 5:
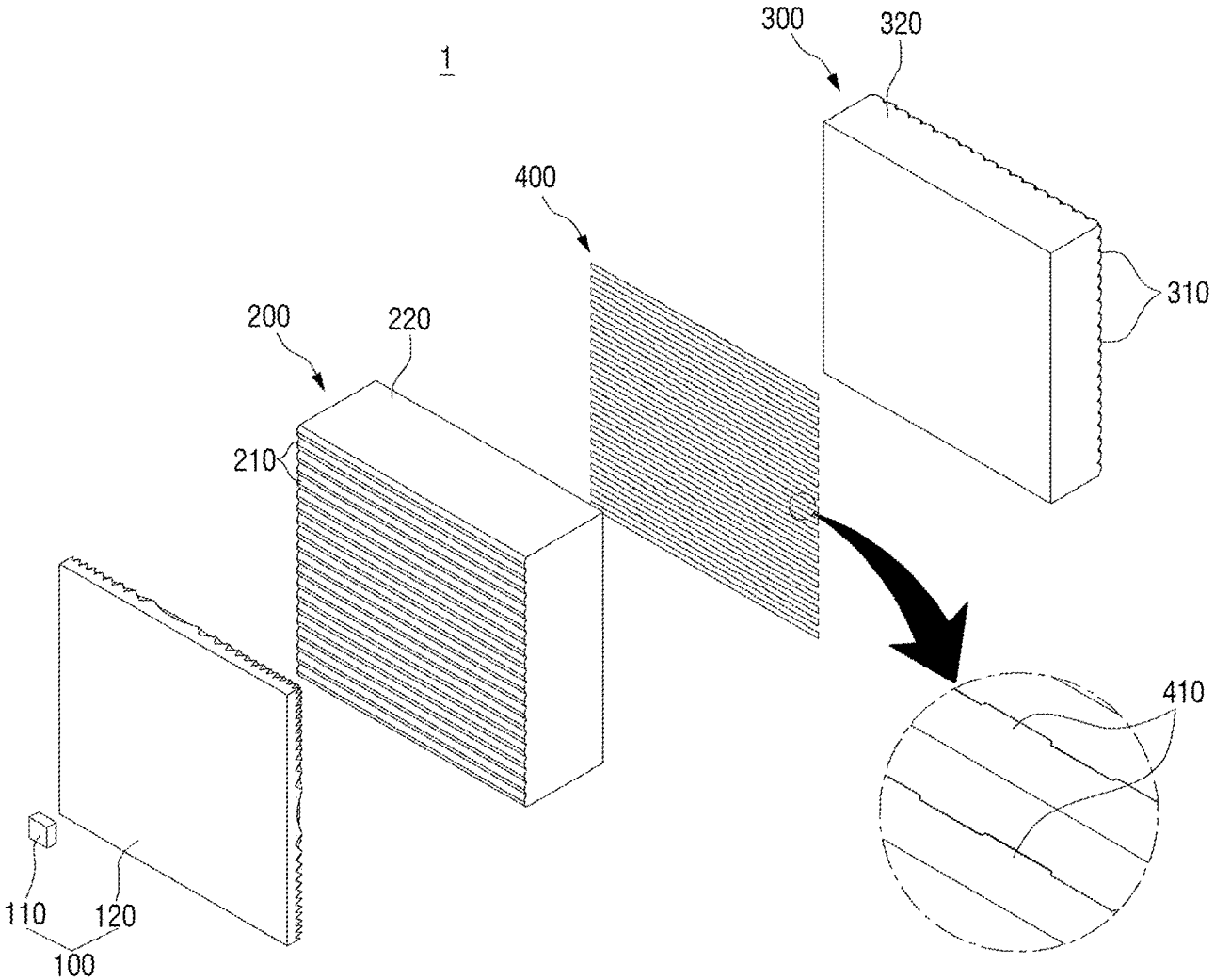

FIGS. 1 and 2 are perspective views of a lamp for a vehicle according to some exemplary embodiments of the present disclosure, FIG. 3 is a side view of the lamp for the vehicle according to some exemplary embodiments of the present disclosure, and FIGS. 4 and 5 are exploded-perspective views of the lamp for the vehicle according to some exemplary embodiments of the present disclosure.

Referring to FIGS. 1 to 5, a lamp 1 for a vehicle according to some exemplary embodiments of the present disclosure may include a light source portion 100, a first lens portion 200, a second lens portion 300, and a shielding portion 400.

In the exemplary embodiments of the present disclosure, the lamp 1 may be a headlamp for ensuring a front field of vision in a vehicle when the vehicle is traveling in low light conditions (e.g., night time) by emitting light in a driving direction or through a dark place such as a tunnel and the like, but is not limited thereto. The lamp 1 may be used not only as a headlamp, but also as any of a variety of lamps installed in a vehicle such as a tail lamp, a brake lamp, a fog lamp, a position lamp, a turn-signal lamp, a daytime running lamp, a backup lamp, and the like.

Also, the exemplary embodiments of the present disclosure will be described regarding the lamp 1, which is used for a headlamp, that forms a low beam pattern having a certain cut-off line to prevent a driver of a vehicle in front or a vehicle approaching in an opposite lane from being blinded, but it is merely an example for aiding in understanding the present disclosure. Accordingly, not limited thereto, a variety of beam patterns may be formed according to use of the lamp 1. Components included in the lamp 1 according to some exemplary embodiments of the present disclosure may be added, deleted, or changed according to each of the beam patterns.

The light source portion 100 may include a light source 110 and a light guide portion 120. In the exemplary embodiments of the present disclosure, a semiconductor light emitting diode (LED) such as an LED lamp may be used as the light source 110. However, the light source 110 is not limited thereto, and a variety of types of light sources such as a bulb and the like may be used as the light source 110 in addition to the semiconductor LED.

The light guide portion 120 may guide light generated by the light source 110 at a certain light irradiation angle, to the first lens portion 200 by adjusting an optical path of the light to be parallel to an optical axis of the light source 110. The optical axis of the light source 110 may be understood as a line which perpendicularly passes a center of a light emitting surface of the light source 110.

The light guide portion 120 may reduce light loss by allowing the light generated by the light source 110 to be incident onto the first lens portion 200 as much as possible (e.g., to a maximum amount) and allow the light which is incident onto the first lens portion 200 to be uniformly incident onto the first lens portion 200 overall by adjusting the optical path of the light to be parallel to the optical axis of the light source 110.

In the exemplary embodiments of the present disclosure, a Fresnel lens configured as a lens having a shape of plural rings may be used as the light guide portion 120 to reduce a thickness thereof and to adjust the optical path of the light generated by the light source 110 to be parallel to the optical axis of the light source 110. However, the present disclosure is not limited thereto, and a variety of types of lenses such as a collimator lens and the like capable of adjusting the optical path of the light generated by the light source 110 may be used as the light guide portion 120.

The first lens portion 200 may include a plurality of micro incident lenses 210 onto which the light generated by the light source portion 100 is incident. Incident surfaces of the plurality of micro incident lenses 210 may collectively form an incident surface of the first lens portion 200, and exit surfaces of the plurality of micro incident lenses 210 may collectively form an exit surface of the first lens portion 200. In addition, the plurality of micro incident lenses 210 may be formed on a surface of a first light transmission portion 220 that is made of a light transmission material, which faces a direction toward the light source portion 100. However, the first light transmission portion 220 is intended to form the first lens portion 200 and the second lens portion 300 as one body and may be omitted when the first lens portion 200 and the second lens portion 300 are disposed separately.

Also, in the exemplary embodiments of the present disclosure, each of the plurality of micro incident lenses 210 may be a semicylindrical lens which extends in a horizontal direction. In particular, the plurality of micro incident lenses 210 may be arranged in a direction perpendicular to the direction in which the semicylindrical lenses extend.

The second lens portion 300 may include a plurality of micro exit lenses 310. Incident surfaces of the plurality of micro exit lenses 310 may collectively form an incident surface of the second lens portion 300, and exit surfaces of the plurality of micro exit lenses 310 may collectively form an exit surface of the second lens portion 300.

In the exemplary embodiments of the present disclosure, the plurality of micro exit lenses 310 may be formed on a surface of a second light transmission portion 320 that is made of a light transmission material, from which light exits. However, the second light transmission portion 320 may be omitted for similar reasons as described above in regards to the first lens portion 200.

Since each of the plurality of micro incident lenses 210 may be a semicylindrical lens, light which exits from one semicylindrical lens may be incident onto several micro exit lenses arranged in the direction in which the semicylindrical lenses extend among the plurality of micro exit lenses. However, the present disclosure is not limited thereto, and the light which exits from each of the plurality of micro incident lenses 210 may be incident onto each of the plurality of micro exit lenses 310 according to a shape of the plurality of micro incident lenses 210.

The shielding portion 400 may be disposed between the first lens portion 200 and the second lens portion 300 and obstruct a portion of light which is incident onto the second lens portion 300 from the first lens portion 200 to form the cut-off line of the beam pattern.

Figure 6:
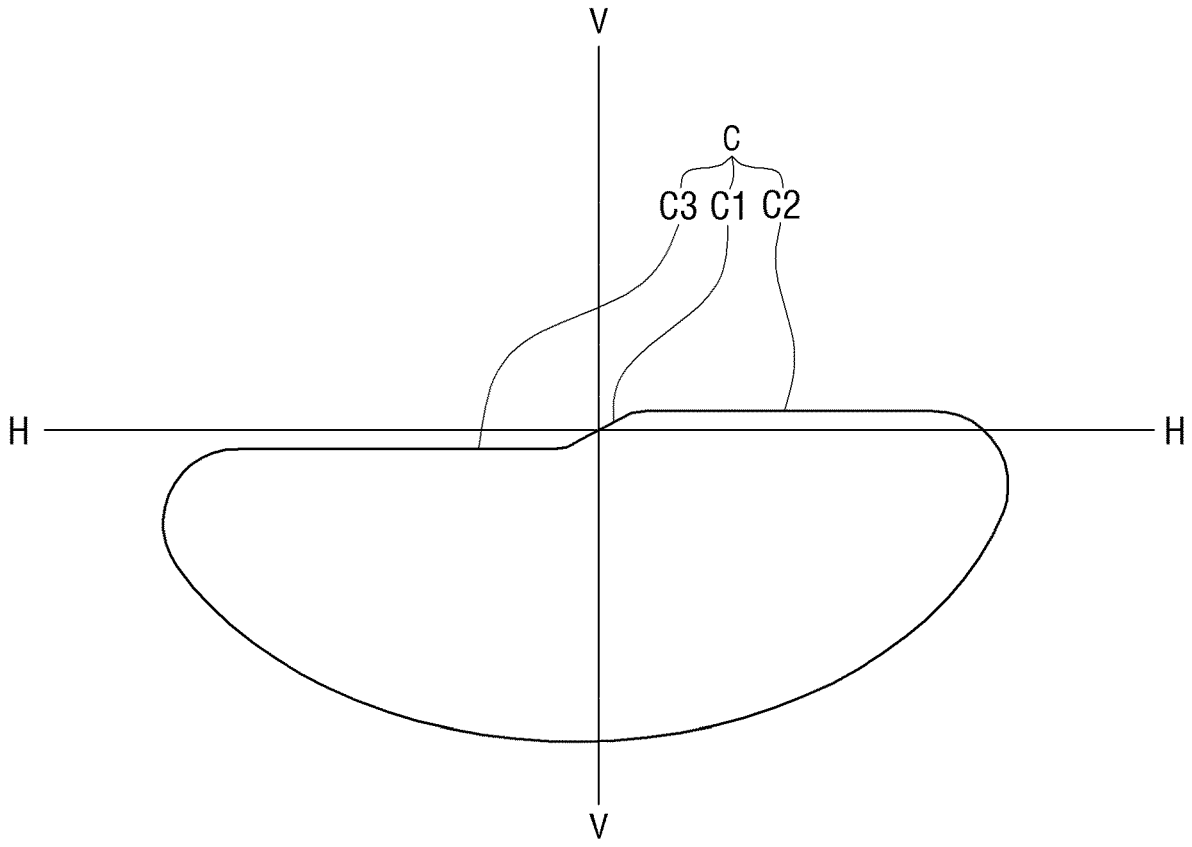
FIG. 6 is a schematic diagram illustrating a beam pattern formed by the lamp for the vehicle according to some exemplary embodiments of the present disclosure.

Referring to FIG. 6, since the lamp 1 may be a headlamp and form the low beam pattern, the shielding portion 400 may form a cut-off line C that includes an inclined edge C1, an upper edge C2, and a lower edge C3. The shielding portion 400 may include a plurality of shields 410 which obstruct a portion of light which is incident onto each of the plurality of micro exit lenses 310.

A top end of each of the plurality of shields 410 may be disposed proximate to a focal point on a rear side of each of the plurality of micro exit lenses 310 and obstruct a portion of light which is incident onto each of the plurality of micro exit lenses 310 such that the cut-off line C as described above with reference to FIG. 6, may be formed.

Figure 7:
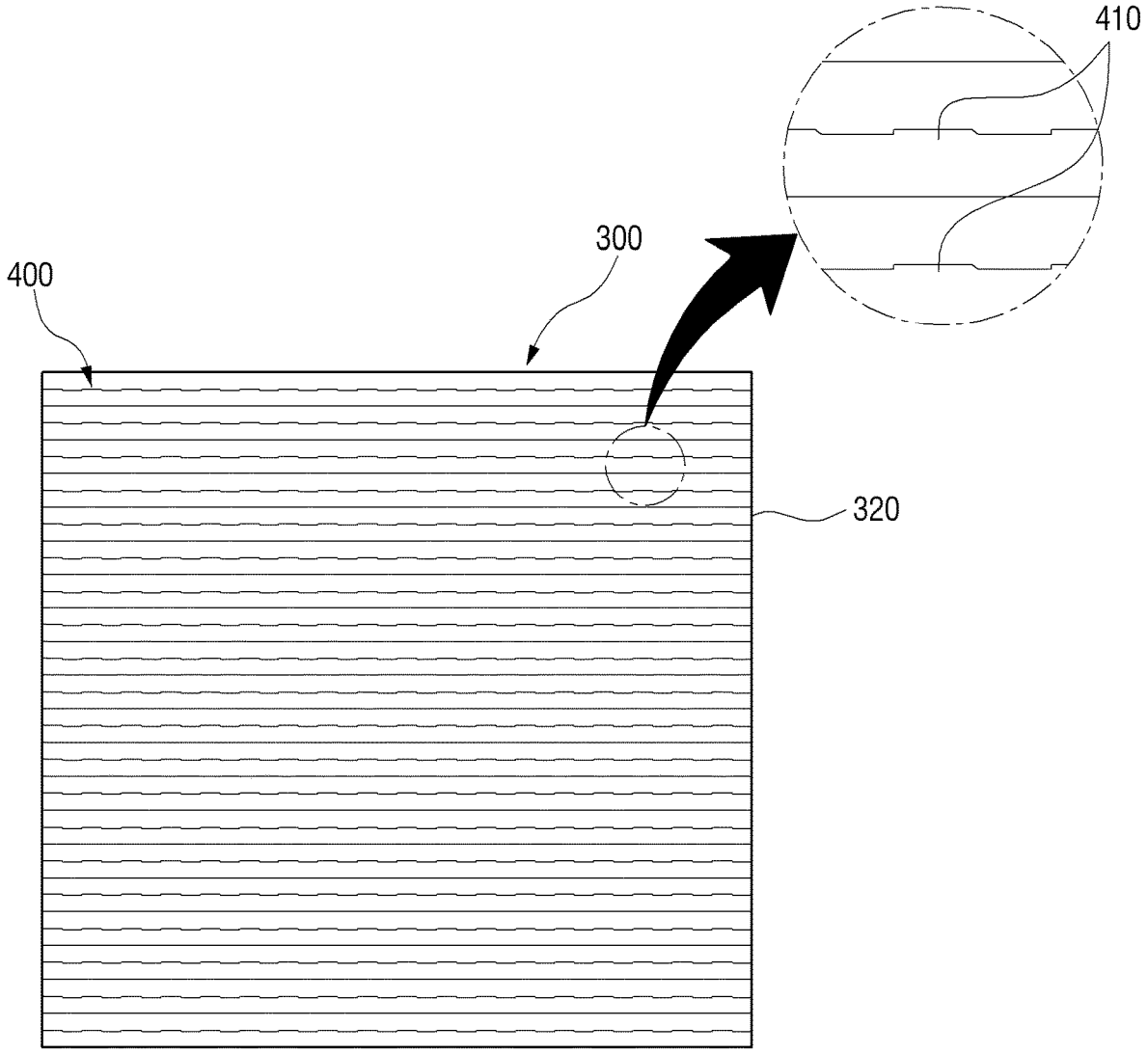
FIG. 7 is a side view illustrating a shielding portion according to some exemplary embodiments of the present disclosure.

As shown in FIG. 7, the plurality of shields 410 may be formed on a surface of the second light transmission portion 320, which faces the first lens portion 200, through deposition or coating thereon.

In addition, in the exemplary embodiments of the present disclosure, since each of the plurality of micro incident lenses 210 may be a semicylindrical lens, some among the plurality of shields 410, which obstruct a portion of the light which exits from any one of the plurality of micro incident lenses 210, may be integrally formed in the direction in which the semicylindrical lenses extend. However, the present disclosure is not limited thereto, and each of the plurality of shields 410 may be separately formed and disposed.

Further, the plurality of shields 410 may be formed on the surface of the second light transmission portion 320, which faces the first lens portion 200, such that a position of the cut-off line C of the low beam pattern may not be changed with respect to a line H-V even when the first lens portion 200 and the second lens portion 300 are not in regular positions thereof.

In other words, when the lamp 1 according to some exemplary embodiments of the present disclosure forms the low beam pattern, the cut-off line C may be formed with respect to the line H-V as described above with reference to FIG. 6. In particular, when the plurality of shields 410 are formed on the second lens portion 300, the position of the cut-off line C may be maintained with respect to the line H-V even when a position of one or both of the first lens portion 200 and the second lens portion 300 is dislocated. However, when the plurality of shields 410 are formed on the first lens portion 200 and the position of at least one of the first lens portion 200 or the second lens portion 300 is dislocated, the position of the cut-off line C may be changed such that a driver of a vehicle in front may be temporarily blinded or a field of vision of the driver may be reduced.

For example, when the plurality of shields 410 are formed on the exit surface of the first lens portion 200 and at least one of the first lens portion 200 and the second lens portion 300 is not in the regular position thereof, the position of the cut-off line C may be moved up or down from an original position thereof.

Figure 8:
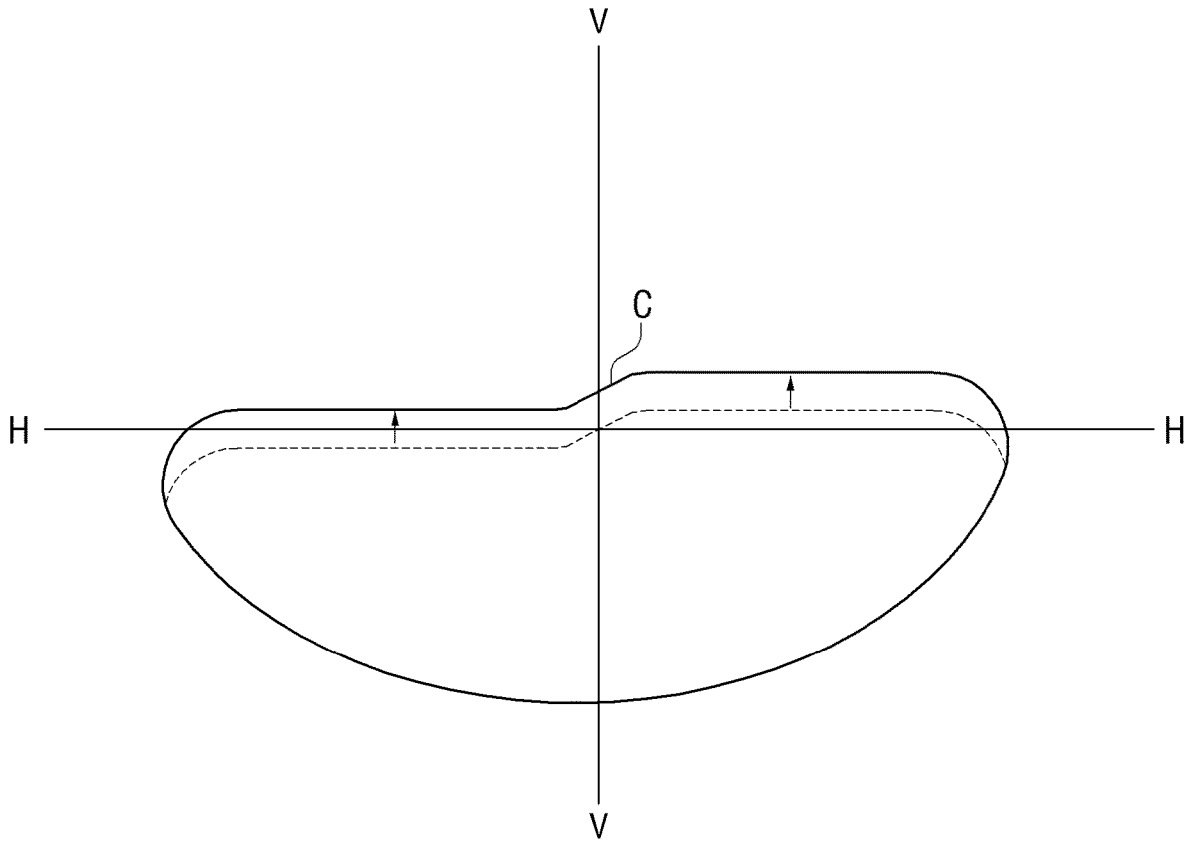
FIGS. 8 and 9 are schematic diagrams illustrating a cut-off line of the beam pattern formed by the lamp for the vehicle according to some exemplary embodiments of the present disclosure.
Figure 9:
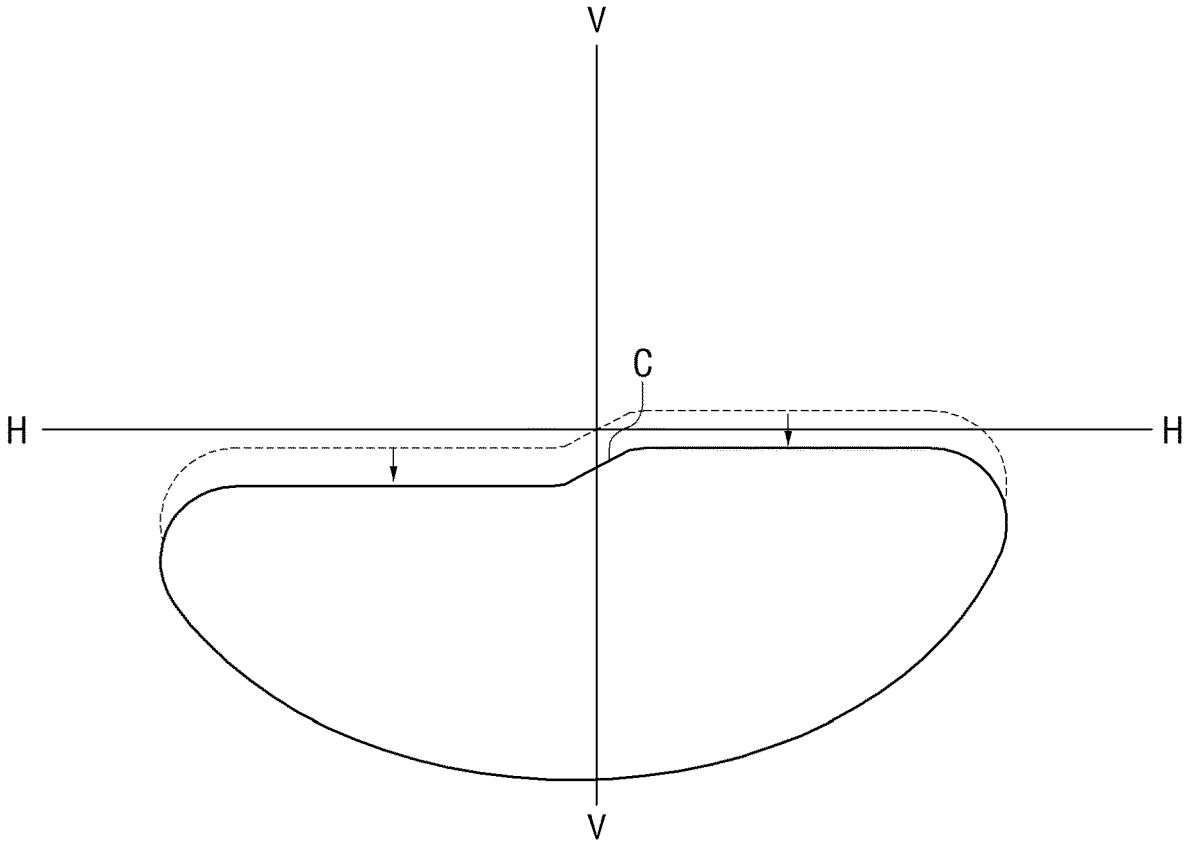

In other words, when the cut-off line C is moved upward from the original position as shown in FIG. 8, a driver of a vehicle in front may be temporarily blinded. When the cut-off line C is moved downward from the original position as shown in FIG. 9, a sufficient field of vision may not be provided. Here, dotted lines shown in FIGS. 8 and 9 may represent the cut-off lines formed in regular positions with respect to the line H-V.

In addition, since the plurality of shields 410 are formed on the surface of the second light transmission portion 320, which faces the first lens portion 200 in the exemplary embodiments of the present disclosure, when the first lens portion 200 and the second lens portion 300 are coupled to each other, both sides of the plurality of shields 410 may come into contact with the first light transmission portion 220 and the second light transmission portion 320.

Meanwhile, as described above, a focal surface which is a virtual surface that includes the focal point on the rear side of each of the plurality of micro exit lenses 310 may be disposed between the plurality of micro incident lenses 210 and the plurality of micro exit lenses 310 corresponding to the plurality of micro incident lenses 210 respectively. Light efficiency, which indicates a ratio of an amount of light which exits through the plurality of micro exit lenses 310 to an amount of light generated by the light source 110, may vary based on a position of the focal surface.

Hereinafter, any one of the plurality of micro incident lenses 210 and any one of the plurality of micro exit lenses 310, which correspond to each other, will be described as an example. However, the same may be applied to the others of the plurality of micro incident lenses 210 and the plurality of micro exit lenses 310.

Figure 10A:
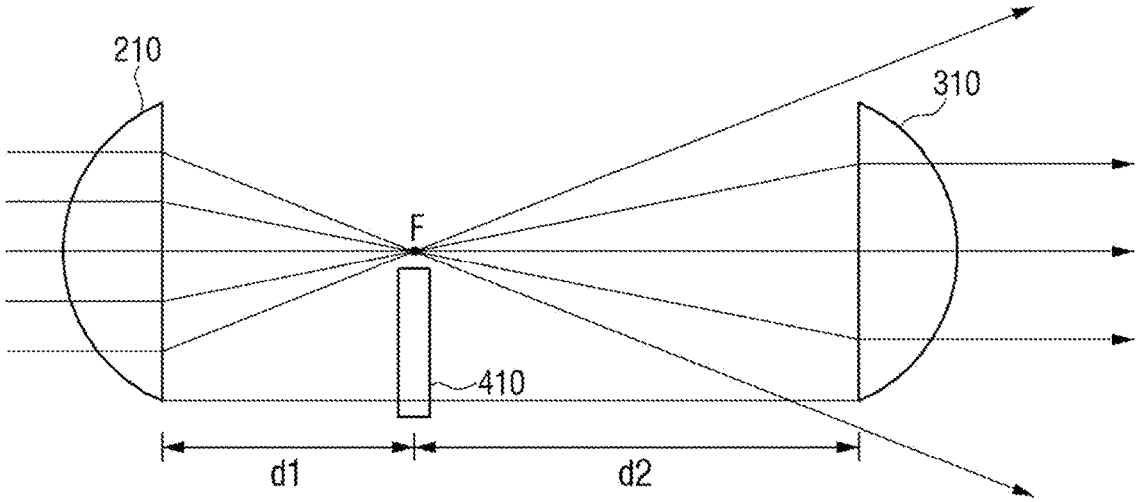
FIGS. 10A and 10B are schematic diagrams illustrating optical paths according to a position of a focal point between a micro incident lens and a micro exit lens according to some exemplary embodiments of the present disclosure.
Figure 10B:
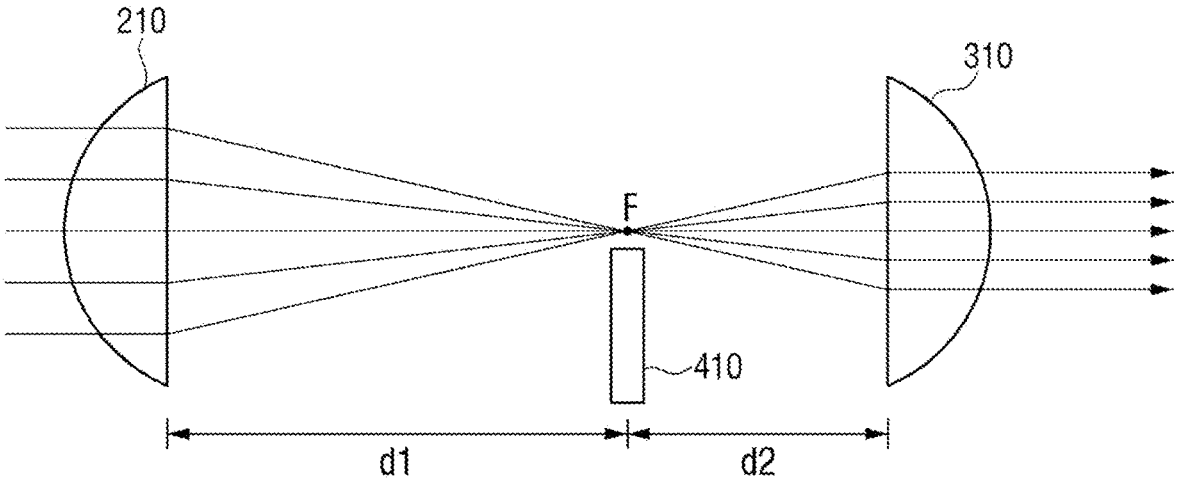

FIGS. 10A and 10B are schematic diagrams illustrating focal distances of the micro incident lenses and the micro exit lenses according to some exemplary embodiments of the present disclosure. FIGS. 10A and 10B illustrate one example of one micro incident lens and one micro exit lens, which correspond to each other, among the plurality of micro incident lenses 210 and the plurality of micro exit lenses 310.

Referring to FIGS. 10A and 10B, the light which exits from the micro incident lens 210 may pass a focal point F and be incident onto the micro exit lens 310. When a focal distance between the micro incident lens 210 and the focal point F is referred to as d1 and a focal distance between the focal point F and the micro exit lens 310 is referred to as d2, d2 may be shorter than d1 to provide light efficiency that satisfies the performance requirement for light distribution.

In the exemplary embodiments of the present disclosure, since the micro incident lens 210 may be a semicylindrical lens and light may be incident onto several micro exit lenses arranged in the direction in which the semicylindrical lens extends, the above-described d1 and d2 may be understood as distances from the micro incident lens 210 and the micro exit lens 310 to the focal surface located between the micro incident lens 210 and the micro exit lens 310, respectively.

Referring to FIG. 10A, where d2 is greater than d1, an area onto which the light having passed the focal point F is incident may become greater than the incident surface of the micro exit lens 310 such that light incident on the micro exit lens 310 may be reduced and light efficiency may also be reduced.

Accordingly, in the exemplary embodiments of the present disclosure, d2 may be formed to be shorter than d1 as shown in FIG. 10B such that the light having passed the focal point F is incident onto the incident surface of the micro exit lens 310 so as to increase light efficiency.

Here, since the light source 110 is essentially a surface light source having a light emitting surface with a predetermined size, even when d1 and d2 are equal to each other, part of light which passes the focal point F may deviate from the incident surface of the micro exit lens 310. Accordingly, d2 may be shorter than d1.

Also, d2 being shorter than d1 means that the shield 410 disposed proximate to the focal point F may be disposed closer to the micro exit lens 310 than the micro incident lens 210. It will be understood that the shielding portion 400 may be disposed closer to the second lens portion 300 than the first lens portion 200.

Meanwhile, as described above, when the micro incident lens 210 is formed on a surface of the first light transmission portion 220, which faces a direction toward the first light source portion 100, the first light transmission portion 220 may have a thickness corresponding to the focal distance, which is a distance between the micro incident lens 210 and the focal point F. When the micro exit lens 310 is formed on a surface of the second light transmission portion 320, from which light exits, the second light transmission portion 320 may have a thickness corresponding to a focal distance, which is a distance between the focal point F and the micro exit lens 310.

In the exemplary embodiments of the present disclosure, a ratio of d2 to d1 (d2/d1) may be from 0.4 to 0.8 (40% to 80%). In this case, light efficiency for satisfying light distribution performance requirements may be provided when the lamp 1 is used as a headlamp.

For example, to provide sufficient visibility when the lamp 1 is used as a headlamp, an amount of light emitted from the lamp 1 may be at least 600 lm. In consideration of an amount of light generally generated by the light source 110, it may be necessary to have light efficiency of at least 30% or more. When the ratio of d2 to d1 is greater than 0.8, as described with reference to FIG. 10A, the amount of light that deviates from the incident surface of the micro exit lens 310 may increase. When the ratio of d2 to d1 is smaller than 0.4, the amount of light totally reflected by the micro exit lens 310 may increase such that light efficiency is reduced.

In other words, as the ratio of d2 to d1 decreases, it may be necessary that a curvature of the exit surface of the micro exit lens 310 further increases to concentrate the light which exits from the micro exit lens 310. In this case, since an area of the exit surface of the micro exit lens 310, in which the light is totally reflected, relatively increases, an amount of light which exits through the micro exit lens 310 may be reduced.

Figure 11:
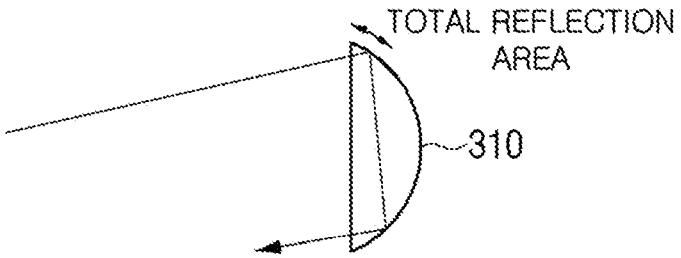
FIG. 11 is a schematic diagram illustrating a curvature of the micro exit lens according to a ratio of a focal distance between a focal point and the micro exit lens to a focal distance between the micro incident lens and the focal point.
Figure 11:
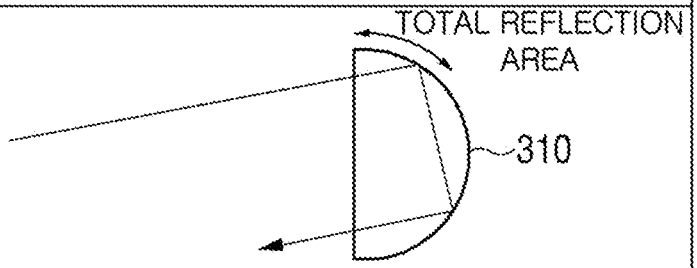

For example, the curvature of the micro exit lens 310 may vary based on the ratio of d2 to d1 as shown in FIG. 11, and the curvature may be relatively greater when the ratio of d2 to d1 is smaller than 0.4 than when the ratio of d2 to d1 is from 0.4 to 0.8.

In particular, as the curvature of the micro exit lens 310 increases, a total reflection area of the micro exit lens 310, in which the light which is incident onto the micro exit lens 310 is totally reflected, may relatively increase such that the light efficiency may decrease.

Accordingly, in the exemplary embodiments of the present disclosure, to allow the lamp 1 to satisfy light distribution performance requirements, the ratio of d2 to d1 may be from 0.4 to 0.8 (40% to 80%) such that adequate light efficiency is achieved.

Since the lamp 1 may satisfy the necessary light distribution performance requirements by adjusting the focal distances of the micro incident lens 210 and the micro exit lens 310 with respect to the focal point F, additional light sources or components for increasing light efficiency may be unnecessary such that it may prevent an increased cost and a complicated structure.

According to the exemplary embodiments of the present disclosure, a lamp for a vehicle may provide one or more effects as follows.

Since the light, which exits from a micro incident lens, may be allowed to be incident onto a micro exit lens as much as possible by adjusting a position of a focal point formed between the micro incident lens and the micro exit lens such that light distribution performance requirements may be satisfied without an additional component for improving light efficiency, effects of simplifying a configuration and reducing costs may be achieved.

Effects of the present disclosure will not be limited to the above-mentioned effects and other unmentioned effects will be clearly understood by those skilled in the art from the following claims.

It should be understood by one of ordinary skill in the art that the present disclosure can be embodied in other specific forms without changing the technical concept and essential features of the present disclosure. Therefore, the above-described embodiments should be understood to be exemplary and not limiting in every aspect. The scope of the present disclosure will be defined by the following claims rather than the above detailed description, and all changes and modifications derived from the meaning and the scope of the claims and equivalents thereof should be understood as being included in the scope of the present disclosure.

What is claimed is:

1. A lamp for a vehicle comprising:

a light source portion;

a first lens portion that includes a plurality of micro incident lenses onto which light generated by the light source portion is incident;

a second lens portion that includes a plurality of micro exit lenses corresponding to the plurality of micro incident lenses, respectively; and a shielding portion that includes a plurality of shields, each of which is disposed at each rear focal point of the plurality of micro exit lenses to obstruct a portion of light that is incident onto the plurality of micro exit lenses, wherein a focal distance of a micro exit lens among the plurality of micro exit lenses is designed to be shorter than a focal distance of a micro incident lens among the plurality of micro incident lenses, which corresponds to the micro exit lens, to cause light that passes the rear focal point to be incident onto and exit the micro exit lens with a light efficiency equal to or greater than a predetermined minimum light efficiency.

2. The lamp of claim 1, wherein each of the plurality of micro incident lenses is a semicylindrical lens that extends in one direction, and wherein light which exits from the semicylindrical lens is incident onto at least one of the plurality of micro exit lenses, which is arranged in the one direction in which the semicylindrical lens extends.

3. The lamp of claim 1, wherein the focal distance of the micro exit lens is 40% to 80% of the focal distance of the micro incident lens.

4. The lamp of claim 1, wherein in the first lens portion, the plurality of micro incident lenses are formed on a surface of a first light transmission portion, which faces a direction toward the light source portion, wherein in the second lens portion, the plurality of micro exit lenses are formed on a surface of a second light transmission portion, from which light exits, and wherein the first light transmission portion and the second light transmission portion are disposed such that mutually facing surfaces abut each other.

5. The lamp of claim 4, wherein the plurality of shields are formed by a deposition on a surface of the second light transmission portion, which faces the first light transmission portion.

6. The lamp of claim 4, wherein the first light transmission portion has a thickness corresponding to the focal distance of the micro incident lens, and wherein the second light transmission portion has a thickness corresponding to the focal distance of the micro exit lens.

7. The lamp of claim 1, wherein the light source portion comprises a light source and a light guide portion configured to guide the light generated by the light source to the first lens portion by adjusting an optical path of the light to be parallel to an optical axis of the light source.

8. The lamp of claim 7, wherein the light guide portion is a Fresnel lens.

9. The lamp of claim 1, wherein a curvature of an exit surface of the micro exit lens increases as the focal distance of the micro exit lens decreases.

10. The lamp of claim 1, wherein the shielding portion is disposed closer to the second lens portion than the first lens portion.

11. The lamp of claim 1, wherein a cut-off line of each of the plurality of shields is connected to cut-off lines of adjacent shields.

* * * * *